US012398488B2

(12) United States Patent
Mann et al.

(10) Patent No.: US 12,398,488 B2
(45) Date of Patent: Aug. 26, 2025

(54) CELLULOSE ACETATE-CONTAINING FIBROUS MATERIAL FOR A NONWOVEN PRODUCT, NONWOVEN PRODUCT COMPRISING SUCH A FIBROUS MATERIAL, AND METHOD FOR PRODUCING SUCH A FIBROUS MATERIAL

(71) Applicant: CERDIA INTERNATIONAL GMBH, Basel (CH)

(72) Inventors: Dieter Mann, Oberried (DE); Martin Moser, Oberprechtal (DE); Uwe Schäffner, Vörstetten (DE)

(73) Assignee: CERDIA INTERNATIONAL GMBH (CH)

( * ) Notice: Subject to any disclaimer, the term of this patent is extended or adjusted under 35 U.S.C. 154(b) by 164 days.

(21) Appl. No.: 17/795,765

(22) PCT Filed: Jan. 12, 2021

(86) PCT No.: PCT/EP2021/050449
§ 371 (c)(1),
(2) Date: Jul. 27, 2022

(87) PCT Pub. No.: WO2021/151653
PCT Pub. Date: Aug. 5, 2021

(65) Prior Publication Data

US 2023/0070303 A1 Mar. 9, 2023

(30) Foreign Application Priority Data

Jan. 29, 2020 (DE) ..... 10 2020 102 096.1

(51) Int. Cl.

| | |
|---|---|
| ***D01F 2/28*** | (2006.01) |
| ***D01D 5/24*** | (2006.01) |
| ***D04H 1/4391*** | (2012.01) |
| ***D04H 3/005*** | (2012.01) |
| ***D04H 3/018*** | (2012.01) |

(52) U.S. Cl.
CPC ..... *D01F 2/28* (2013.01); *D01D 5/24* (2013.01); *D04H 1/43914* (2020.05); *D04H 1/43918* (2020.05); *D04H 3/005* (2013.01); *D04H 3/018* (2013.01)

(58) Field of Classification Search
CPC ..... D04H 1/43914; D04H 1/43918; D04H 3/0005; D01D 5/24; D01F 2/28
USPC ..... 428/373
See application file for complete search history.

(56) References Cited

U.S. PATENT DOCUMENTS

| | | | | |
|---|---|---|---|---|
| 4,276,173 | A | 6/1981 | Kell et al. | |
| 2007/0074733 | A1* | 4/2007 | Rasouli | A24D 3/14 131/345 |
| 2020/0071882 | A1* | 3/2020 | Chambers | D04H 1/541 |

FOREIGN PATENT DOCUMENTS

| | | | |
|---|---|---|---|
| CN | 203315406 | U | 12/2013 |
| CN | 103735363 | A | 4/2014 |
| CN | 104797149 | A | 7/2015 |
| CN | 108660610 | A | 10/2018 |
| CN | 110352269 | A | 10/2019 |
| DE | 2827100 | A1 | 1/1979 |
| EP | 0547498 | A2 | 6/1993 |
| EP | 0632969 | A2 | 1/1995 |
| EP | 0634113 | A2 | 1/1995 |
| EP | 3128070 | A1 | 2/2017 |
| JP | 5576106 | A | 6/1980 |
| JP | H05-199973 | A | 8/1993 |
| JP | H05-261051 | A | 10/1993 |
| JP | H08-120517 | A | 5/1996 |
| JP | H08260343 | A | 10/1996 |
| JP | H10-305220 | * | 11/1998 |
| JP | 2002-302861 | A | 10/2002 |
| RU | 2082303 | C1 | 6/1997 |
| RU | 2170779 | C2 | 7/2001 |
| RU | 2655203 | C2 | 5/2018 |
| RU | 2710434 | C2 | 12/2019 |
| WO | 2015194007 | A1 | 12/2015 |
| WO | 2017060393 | A1 | 4/2017 |
| WO | 2020046634 | A1 | 3/2020 |
| WO | 2020200873 | A1 | 10/2020 |

OTHER PUBLICATIONS

Wang et al., Electrodialysis and Reverse Osmosis (Water Treatment), First Edition, Feb. 29, 1980, p. 216, China.
Yang, et al., Industrialized New Textile Materials, First Edition, Apr. 30, 2012, pp. 126-128, China.

* cited by examiner

*Primary Examiner* — Camie S Thompson
(74) *Attorney, Agent, or Firm* — Greenberg Traurig, LLP

(57) ABSTRACT

The invention relates to a cellulose-containing fibrous material for a nonwoven product, in particular in the form of a wiping cloth, cleaning cloth, sanitary product, medicinal product, or domestic cloth, wherein the fibrous material is designed as a tubular composite structure at least in part or in some regions, said structure having tubular cellulose acetate filaments. The invention additionally relates to a nonwoven product which has the fibrous material according to the invention and to a method for producing such a cellulose acetate-containing fibrous material.

10 Claims, No Drawings

CELLULOSE ACETATE-CONTAINING FIBROUS MATERIAL FOR A NONWOVEN PRODUCT, NONWOVEN PRODUCT COMPRISING SUCH A FIBROUS MATERIAL, AND METHOD FOR PRODUCING SUCH A FIBROUS MATERIAL

CROSS-REFERENCE TO RELATED APPLICATIONS

The present application is a national phase application under 35 USC § 371 of International Application No. PCT/EP2021/050449, filed on Jan. 12, 2021, which claims priority to Germany Patent Application No. DE 10 2020 102 096.1 filed on Jan. 29, 2020, the entire contents and disclosures of all of which are hereby incorporated by reference herein.

The present invention relates to cellulose acetate-containing fibrous materials and products obtainable therefrom. These in particular include flat products such as nonwovens.

One particularly preferential aspect of the invention relates to wiping cloths, cleaning cloths, sanitary products, medical products and household wipes made from such cellulose acetate-containing fibrous materials which are characterized by advantageous properties, particularly with respect to their performance vis-à-vis external moisture.

The invention further provides methods for producing the cellulose acetate-containing fibrous materials and the products derived therefrom.

Flat products containing cellulose acetate-containing fibrous materials according to the invention, or being produced therefrom respectively, may come in various forms. So-called nonwoven products are one such example.

Today, nonwovens are recognized as a separate product group. Nonwovens comprise nonwoven materials and nonwoven fabrics and finished products produced therefrom, often for cleaning and hygiene needs. These commonly textile-like composites constitute flexible, porous textile fabrics not of traditional fabric weave methods of warp and weft or of stitching but of interlocking and/or cohesive and/or adhesive bonding of typical synthetic textile fibers which can be in the form of, for example, continuous filaments or prefabricated filaments of finite length, synthetic filaments generated in-situ or staple fibers.

Alternatively, they can be produced from blends of synthetic fibers in the form of staple fibers and natural fibers, for example natural plant-based fibers.

Hydrophobic properties are undesirable in nonwoven products of the type considered herein, particularly flat textile fabrics such as nonwoven fabrics, for example. Example uses of such nonwoven products in the form of nonwoven fabrics are cleaning and wiping cloths, dishcloths and napkins. In these uses, it is important for spilled liquids such as e.g. milk, coffee, etc. to be soaked up quickly and completely when being wiped up and for wet surfaces to be dried as completely as possible. A cleaning cloth absorbs liquid more quickly the faster it is transported to the fiber surface, whereby watery liquids readily and quickly wet fibers having a hydrophilic surface.

In order to hydrophilize the surfaces of flat textile fabrics and thus improve the water absorption properties of the textile fabric, particularly nonwoven fabrics, surface-active hydrophilicizing agents such as emulsifiers, surfactants or wetting agents are usually used. Doing so achieves excellent initial hydrophilicity. However, these textile fabrics, e.g. nonwoven fabrics, have the disadvantage of the hydrophilic agents being gradually leached out by water or other watery media.

In particular, the product becomes increasingly hydrophobic after repeated contact with water.

A further disadvantage of known surface-active agents is the sharp decrease in the water surface tension such that in many applications, particularly in the case of hygiene and cleaning nonwovens, there is an undesirable increase in permeation tendency and the wettability of the soaked up liquid.

The present invention is therefore based on the task of providing hydrophilic linear or flat fabrics as well as a method for increasing the surface hydrophilicity of such fabrics.

This task is in particular solved by a cellulose acetate-containing fibrous material in accordance with independent claim 1, whereby advantageous further developments of the inventive fibrous material are specified in the dependent claims.

Accordingly, the invention relates in particular to a cellulose acetate-containing fibrous material for a nonwoven product, particularly in the form of a wiping cloth, cleaning cloth, sanitary product, medical product or household wipe, wherein the fibrous material is at least in part or partially designed as a tubular composite structure comprising tubular cellulose acetate filaments.

The fibrous material according to the invention is based on the basic concept of taking advantage of the natural hydrophobicity of the tubular cellulose acetate filaments by virtue of capillary action. This thereby achieves the fibrous material having increased surface hydrophilicity even after repeated contact with water.

In particular, the inventive fibrous material is particularly environmentally friendly to produce since applying surface-active hydrophilicizing agents such as emulsifiers, surfactants or wetting agents can be completely dispensed with.

The inventive fibrous material consists of cellulose acetate filaments so that the fibrous material is wholly biocompatible and biodegradable. The fibrous material is in principle just as decomposable as wood, for example, whereby, however, optimal water absorption comparable to the corresponding values able to be attained with polyester, polyamide or polyacrylic microfibers is achievable through the surface and in the capillaries due to the tubular composite structure.

The cellulose acetate filaments making up the fibrous material advantageously exhibit triangular or star-shaped hollow sections so as to form a larger contact surface than the fibers usually used in cleaning cloths.

Preferably, the cellulose acetate filaments are relatively large compared to the fibers usually used in cleaning cloths and are for example between 5 and 30 den or dtex. The inventive fibrous material is thereby particularly suited to cleaning surfaces, for example tiles, tilings, mirrors or glass.

The fibrous material consists of cellulose acetate filaments and/or cellulose acetate staple fibers formed by forcing a solution of cellulose acetate having an acetyl value of at least 53% in acetone through a multi-orifice spinneret. If applicable, the cellulose acetate filaments are then subsequently cut into cellulose acetate staple fibers. The cellulose acetate filaments are gathered into a filter tow which can be crimped as needed.

It is thereby in particular provided for the spinneret through which the solution of cellulose acetate is forced to be designed such that hollow cellulose acetate filaments are externally spun.

In particular, the hollow portion in the tubular composite structure of the cellulosic acetate-containing fibrous material amounts to 25% to 90% and preferably 50% to 80%. This hollow portion makes a crucial contribution to the permanent hydrophilic effect able to be achieved with the fibrous material, same only being able to be achieved due to the hollow fibers of the tubular composite structure which is not, however, the case with closed filaments, e.g. with conventional microfibers made of polyester, polyamide or polyacrylic or with natural fibers. The hollow portion thereby corresponds to the ratio of "hollow" area to the "total" area of the fiber cross section.

To be noted in this context is that the inventive fibrous material in particular also differs from the polyester, polyamide or polyacrylic fibers known from the prior art in that the filament diameter of the cellulose acetate filaments is significantly larger than the filament diameter of other (synthetic) hollow fibers, their filament diameter being in the range of between 1 and 25 μm.

In contrast thereto, the filament diameter of the hollow cellulose acetate filaments ranges between 50 and 150 μm, and is preferably in a range of between 60 and 100 μm (outer diameter). This thereby enables significantly increasing the hollow portion and thus the specific capillary action of the inventive fibrous material.

Moreover, the inventive fibrous material is characterized by being able to be realized with virtually no chemicals without thereby needing to accept any decline in the water absorption properties of the fibrous material after repeated contact with water.

Furthermore, cellulose acetate filaments as are used for the tubular composite structure of the inventive fiber material are already known from the cigarette industry with respect to cigarette filters, for example. This material (cellulose acetate) poses absolutely no health threat such that the inventive fibrous material is also particularly suitable for sanitary products or hygiene items.

A further advantage to be noted is that the inventive fibrous material can be produced with existing equipment for the production of filter tow material. No increased costs are to be thus expected in producing the fibrous material according to the invention such that the fibrous material itself is relatively easy to produce.

To produce the fibrous material according to the invention, a tow material is first produced from uncrimped continuous cellulose acetate filaments. It is then subsequently crimped or not crimped and cut into fiber, whereby typical fiber lengths are 10 to 80 mm long, preferentially 20 to 50 mm long.

With regard to the tubular composite structure of the inventive fibrous material, embodiments provide for it to exhibit tubular and crimped continuous cellulose acetate filaments. Yet the invention is not limited to cellulose acetate filaments; it was in fact discovered that excellent capillary action and thus a good and permanent water absorption property is likewise achievable when the tubular composite structure exhibits tubular, crimped and cut continuous cellulose acetate filaments.

In order to improve the biodegradability of the inventive fibrous material, and do so under the effects of environmental influences, embodiments of the inventive solution provide for the tubular composite structure composed of cellulose acetate filaments to comprise an additive which is preferably applied to at least part of the surface of the cellulose acetate filaments, whereby this additive consists of a nitrogenous organic compound which, when broken down by microorganisms, produce basic products of decomposition comprising in particular ammonia and/or alkaline compounds such as an NH group or NH groups and/or an NFL group or NFL groups.

The nitrogenous organic compound is preferentially urea or a urea derivative. These substances are preferential due to posing no harm to health, and in particular also with respect to food safety regulations, and are available in large quantities at a reasonable price.

On the other hand, the nitrogenous organic compound can also consist of a protein, whereby beta-lactoglobulin is very particularly preferential. Proteins also pose no risk from a health standpoint and in the case of beta-lactoglobulin, the production of cheese yields large quantities as an industrially underutilized byproduct.

It is further preferential for the nitrogenous organic compound to be a condensate of an aldehyde with ammonia or an amine, wherein this condensate is very particularly preferentially hexamethylenetetramine.

Lastly, it is preferential for the nitrogenous organic compound to be a cyclic compound, particularly carbazole. However, other nitrogenous organic compounds can of course also be used, whereby care should be taken to ensure they are as non-toxic as possible.

Alternatively or additionally thereto, the biodegradability of the inventive fibrous material can be improved by the admixture of MgO.

Provided according to implementations of the inventive fibrous material is for the tubular composite structure formed from the cellulose acetate filaments to consist of an acetone-soluble cellulose acetate having an acetyl value of less than 60%, preferably an acetyl value between 53% and 75%. This thus ensures that the cellulose acetate hydrolysis preceding the biodegradation takes less time.

The tow material, which serves as the starting point for the production of the fiber material according to the invention, can be uncrimped (crimp index=0). Although at a 0% crimp index the material cannot be tufted, the uncrimped material can be used in thin flat layers.

Preferentially, however, the tow material which serves as the starting point for the production of the inventive fiber material has a crimp index of 5 to 40% and preferably 10% to 20%.

This thereby achieves optimal crosslinking of the cellulose acetate filaments, whereby the tubular composite structure at the same time provides a large number of capillaries, as is necessary for increased water absorption property of the fibrous material.

The crimp index $I_x$ is a measure of the crimping intensity. The crimp index of a filter tow is determined by a tensile test (force/elongation relationship). It is defined as the ratio of the stretched length $L_2$ under test load minus the initial length to the initial length under preload $L_1$:

$$I_x = L_2 - L_1 / L_1 * 100\%$$

The test load is thereby 25 N and the preload is 2.5 N. The clamping length is 250 mm. The crimp index is determined in a tensile test at a constant strain rate of 300 mm/min on a G02 device from the Borgwaldt GmbH company in Hamburg. Ten individual measured values are recorded per measurement. Testing ensues under standard climate conditions: 20° C. and 60% relative humidity.

Preferentially, the total titer-based tear strength of the tow material, being the starting point for the inventive fibrous material, is preferably no more than 15 cN/tex and even more preferentially 8 cN/tex at most. This feature facilitates the mechanical disintegration preceding biodegradation. The use of cut continuous cellulose acetate filaments is additionally advantageous.

According to embodiments of the present invention, the total titer-based tear strength, and thus the tensile strength of the tow material, the starting point for the inventive fibrous material, is between 6 to 20 cN/tex and preferably between 8 and 12 cN/tex for crimped tow. The tear strength/tensile strength for uncrimped or only slightly crimped tow material can go up to 20 cN/tex.

Within the meaning of the present invention, a tow material is generally to be understood as a strand of multiple cellulose acetate filaments and/or cellulose acetate staple fibers. A filament is understood to mean a virtually endless fiber and the term "staple fiber" denotes a fiber of limited length. These are in particular cut fibers having typical lengths between 10 and 60 mm. Such staple fibers are particularly suitable for use in nonwoven products having a particularly high water absorption property.

Within the meaning of the present invention, the acetyl value is understood to mean the percentage of bound acetic acid in the cellulose acetate, and that being expressed in mass percent.

Various different advantages are in summary achieved with the fibrous material according to the invention. On the one hand, the tubular composite structure formed from cellulose acetate is suitable for specialized applications in the medical field yet can nevertheless be produced relatively inexpensively. Also applicable to the inventive fibrous material is that compared to known fibrous polyolefin materials, it exhibits an accelerated rate of decomposition under environmental influences; yet it is readily feasible to use the fibrous material as a cleaning or wiping cloth, sanitary product, medical product or household cloth under today's usual conditions without the risk of microbiological degradation.

The tubular cellulose acetate filaments are essentially produced by spinning cellulose acetate filaments by way of forcing a solution of cellulose acetate in acetone through a multi-orifice spinneret and, if applicable, subsequently cutting the cellulose acetate filaments into cellulose acetate staple fibers and gathering a plurality of the thusly obtained cellulose acetate filaments and/or cellulose acetate staple fibers into a tow material.

In order to achieve the presence of the additive in the cellulose acetate filaments and in the cellulose acetate staple fibers, said additive can be supplied to the aforementioned solution of cellulose acetate in acetone, after which it is spun.

In order to achieve the presence of the additive; i.e. the optionally added compound, on the surface of the cellulose acetate filaments and cellulose acetate staple fibers, said additive can be applied to these filaments or the cellulose acetate staple fibers formed therefrom during the production of the tow material but after the cellulose acetate filaments have been formed. For example, the additive can be applied to the filaments immediately prior to the cellulose acetate filaments being cut into cellulose acetate staple fibers or the additive can be applied to the finished tow material, thus to the filaments and/or staple fibers after the cellulose acetate filaments and/or cellulose acetate staple fibers having been gathered into tow material.

According to implementations of the present invention, a so-called processing device which can comprise a pair of rollers for continuously pulling a continuous strip of tow material from a tow bale is used in order to tuft the provided tow material which, if applicable, comprises the optionally provided additive. After removal from the tow bale, the tow strip passes two air jets serving to spread and loosen the fabric of the tow strip on its way to the pair of rollers at which it is guided over a deflection roller.

The invention not only relates to the optimized fibrous material but also to the use of the fibrous material as a nonwoven product, in particular in the form of a cleaning or wiping cloth, a sanitary product, a medical cloth or a household cloth. For example, the inventive fibrous material can be used in many varied forms in textiles for cleaning, particularly as a cleaning cloth, cleaning glove, cleaning belt and/or cleaning disc for cleaning machines, as well as for further purposes.

The invention claimed is:

1. A cellulose acetate-containing fibrous material comprising:

a tubular composite structure comprising a plurality of tubular cellulose acetate filaments;

wherein each of the plurality of tubular cellulose acetate filaments comprises a first end and a second end opposite the first end;

wherein each of the plurality of tubular cellulose acetate filaments has a length of 10 mm to 80 mm, wherein the tubular composite structure comprises a hollow portion, wherein the hollow portion of the tubular composite structure has an area that is 25% to 90% of a total area of a cross-section of the tubular composite structure, and wherein the plurality of tubular cellulose acetate filaments comprises a fineness of 5 denier to 30 denier.

2. The fibrous material according to claim 1, wherein the plurality of tubular cellulose acetate filaments comprises at least one of crimped continuous cellulose acetate filaments or cut continuous cellulose acetate filaments.

3. The fibrous material according to claim 2, wherein a crimp index of the crimped continuous cellulose acetate filaments is between 0% and 40%.

4. The fibrous material according to claim 1, wherein the plurality of tubular cellulose acetate filaments are mutually distanced from one another in an irregular arrangement, wherein the plurality of tubular cellulose acetate filaments are connected with one another, and wherein the connected plurality of tubular cellulose acetate filaments are intertwined, entangled or bonded with one another.

5. The fibrous material according to claim 1, wherein a filament diameter of the plurality of tubular cellulose acetate filaments is 50 μm and 150 μm.

6. The fibrous material according to claim 1, wherein the plurality of tubular cellulose acetate filaments comprise a wall thickness of 5 μm to 15 μm.

7. The fibrous material according to claim 1, wherein the plurality of tubular cellulose acetate filaments comprise a tensile strength of 5 cN/tex to 15 cN/tex.

8. The fibrous material according to claim 1, wherein the plurality of tubular cellulose acetate filaments comprise an elongation of 5% and 20%.

9. A cellulose acetate-containing fibrous material comprising:

a tubular composite structure comprising a plurality of tubular cellulose acetate filaments;

wherein each of the plurality of tubular cellulose acetate filaments comprises a first end and a second end opposite the first end;

wherein each of the plurality of tubular cellulose acetate filaments has a length of 10 mm to 80 mm, wherein the tubular composite structure comprises a hollow portion, wherein the hollow portion of the tubular composite structure has an area that is 25% to 90% of a total area of a cross-section of the tubular composite structure, and wherein the plurality of tubular cellulose acetate filaments comprises a tensile strength of 5 cN/tex to 15 cN/tex.

10. A cellulose acetate-containing fibrous material comprising:

a tubular composite structure comprising a plurality of tubular cellulose acetate filaments;

wherein each of the plurality of tubular cellulose acetate filaments comprises a first end and a second end opposite the first end;

wherein each of the plurality of tubular cellulose acetate filaments has a length of 10 mm to 80 mm, wherein the tubular composite structure comprises a hollow portion, wherein the hollow portion of the tubular composite structure has an area that is 25% to 90% of a total area of a cross-section of the tubular composite structure, and wherein the plurality of tubular cellulose acetate filaments comprises an elongation of 5% and 20%.

* * * * *